United States Patent [19]

Ratz

[11] Patent Number: 4,510,746

[45] Date of Patent: Apr. 16, 1985

[54] FLEXIBLE BAND

[75] Inventor: Gerhard Ratz, Keltern, Fed. Rep. of Germany

[73] Assignee: Rodi & Wienenberger, Pforzheim, Fed. Rep. of Germany

[21] Appl. No.: 527,310

[22] Filed: Aug. 29, 1983

[30] Foreign Application Priority Data

Sep. 1, 1982 [DE] Fed. Rep. of Germany ... 8224660[U]

[51] Int. Cl.[3] ..... F16G 13/00

[52] U.S. Cl. ..... 59/79.1; 59/79.3; 59/80

[58] Field of Search ..... 59/79.1, 79.3, 80; 63/5 R, 4

[56] References Cited

U.S. PATENT DOCUMENTS

| | | | |
|---|---|---|---|
| 26,932 | 7/1870 | Carlson | 59/79.1 |
| 2,689,450 | 9/1954 | Stiegele | 59/79.1 |
| 2,941,351 | 6/1960 | Dolansky | 59/79.1 |
| 2,957,303 | 10/1960 | Sasaki | 59/79.1 |
| 3,543,507 | 12/1970 | Vanover et al. | 59/79.1 |
| 3,601,977 | 8/1971 | Kunzmann | 59/79.1 |
| 3,820,319 | 6/1974 | Abe | 59/79.1 |
| 4,096,688 | 6/1978 | Rieth | 59/79.1 |
| 4,104,872 | 8/1978 | Dukas | 59/79.1 |

*Primary Examiner*—Daniel C. Crane
*Assistant Examiner*—David B. Jones
*Attorney, Agent, or Firm*—Michael J. Striker

[57] ABSTRACT

A flexible band, in particular a wrist-watch strap, has an upper and a lower layer of link members which are connected to each other by U-shaped clips. The clips cooperate with leaf springs located in the link members in such a manner that the flexures of the clips are in engagement with the flexures of the leaf springs provided at the respective ends. The inner sides of the link members are provided in addition to a recess arranged at each end face thereof with cut-outs through which the flexures of the leaf springs can protrude during stretching of the band.

2 Claims, 3 Drawing Figures

FLEXIBLE BAND

BACKGROUND OF THE INVENTION

The invention relates to a flexible double-layered band of link members, in particular to a wristwatch strap.

In known bands or straps, the upper layer of link members are offset to the lower link members by half the width of the link members and are connected to each other by U-shaped clips which are inserted into the open end faces of the link members. The clips cooperate with leaf springs inserted in the link members.

Such flexible bands are extensively used since they have many advantages in comparison to closing bands. They can be easily put on or drawn off and do not clamp the wrist due to the elasticity and flexibility. Moreover, some of these band structures (for example DE No. 1,557,630) allow an adjustment of the length to the wrist of the user without any difficulty. Furthermore, these bands are relatively cheap since they can be essentially produced in an automatic manner.

Although this principle seems to be rather sound, these known constructions of flexible bands of link members have the disadvantage of relatively large dimensions. Especially when using bands in which the clips are locked with the leaf springs by means of corrugations or transverse grooves, like in the DE No. 896,757 or FR No. 1,554,048, this disadvantage is especially noticeable. The end latches require relatively much space so that the backlash required for stretching of the band is confined. Since the bands, however, should have a large stretching length, the height of the link members is considerable in order to enlarge the angle around which the shanks of the connecting clip are to be pivoted. Since the band has two layers of such link members, the height of such a band is correspondingly doubled.

Since years, the development of mechanical as well as electronic watches has been directed to structural units which are as flat as possible. Consequently, more and more flat wristwatch straps appeared on the market which harmonized with the height of the watch.

In order to reduce the height of such bands or straps, it has been proposed to develop the shanks of the connecting clips and the leaf springs in a smooth manner while the U-shaped clips are secured against falling out by end lugs formed onto the link members (DE No. 1,900,290). Although the entire height or thickness of such a strap is reduced, the adjustment to the length is rather complicated, since the lugs must be upwardly bent at the link members in order to insert or remove the link members from the band. Consequently, there is the danger that the lugs break off, and in any case the band is damaged after shortening at the respective location.

In addition, there are known numerous other modifications of flexible bands of link members. A satisfactory solution, however, for obtaining a very flat band of this kind and which possesses all the advantages thereof has yet to be found.

SUMMARY OF THE INVENTION

It is the object of the present invention to avoid the prior-art disadvantages.

In particular, it is an object of the present invention to provide a flexible band essentially a wristwatch strap which is flatter than all known straps and which allows easy exchanging of individual link members.

A further object of the invention is to provide a band of link members which has a maximum flexibility and elasticity.

A concomitant object of the present invention is to provide a band of link members which is easy to manufacture, reliable in operation and inexpensive nevertheless.

In keeping with these objects and with others which will become more apparent hereinafter-one feature of the present invention resides in a flexible band which comprises an upper and lower layer of link members, a plurality of clips each of which connecting an upper and a lower link member and having two shanks respectively provided with an inwardly directed flexure, and a plurality of springs each of which extending within an associated link member and having a further inwardly directed flexure at each end portion thereof for cooperating with an associated flexure of the clips, wherein each of the link members has an inner side provided with a recess at each front face thereof and a cut-out in the vicinity of each recess so that upon stretching of the band the ends of the respective spring protrudes into the recess and the further flexure thereof protrudes into the cut-out.

In a preferred embodiment of the invention, the cut-outs extend over the entire width of each link member.

Through the provision of the link members according to the invention, the band can be developed in very flat a manner not experienced so far without diminishing the flexibility of the band itself. Upon stretched band, the cut-outs are exposed and allow the protrusion of the flexures of the leaf springs. The angle around which the shanks of the connecting clips are pivoted is not limited prematurely. Even when providing decorative coverings on the upper link members, which means that a doubled material thickness is obtained, the inventive band or strap is of less height than the bands known on the market so far. Although the band is very flat, there is no impairment of the flexibility and elasticity.

The cut-outs need not necessarily extend over the entire width of the link members but can also be narrower. Then, the leaf spring located in the link member is correspondingly developed so that upon stretching of the band the flexure can protrude through the cut-out. However, due to the narrow parts in the leaf spring, the leaf spring force is diminished and, moreover, the provision of the leaf spring as well as of the link members is more complicated in comparison to the preferred embodiment of providing the cut-outs over the entire width.

The U-shaped connecting clips are maintained by the leaf springs in a known manner. The modification of the length can be easily carried out by removing or inserting the clips. There are no other connecting or securing means, like tabs or the like, to fix the clips. An extremely flat wristwatch strap is obtained which is usable in an advantageous manner in extremely flat watches.

The novel features which are considered characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
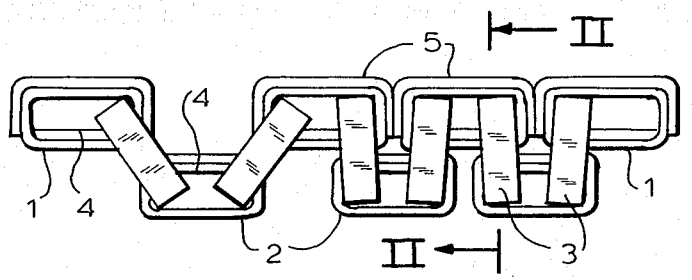
FIG. 1 illustrates the inventive band of link members in a side view and partly stretched.

Referring firstly to FIG. 1, there is shown a flexible band consisting of two superimposed layers of link members 1, 2 which are offset to each other by half a link member width. The link members 1 of the upper layer are connected with the link members 2 of the lower layer by U-shaped connecting clips 3 which are inserted through the open face ends of the respective link members. Located within the link members 1 and 2 are leaf spring 4 which cooperate with the clip 3 during stretching of the band and contracting into the initial position. In order to provide an improved outer appearance, decorative coverings 5 are located above the upper layer of link members 1.

Figure 2:
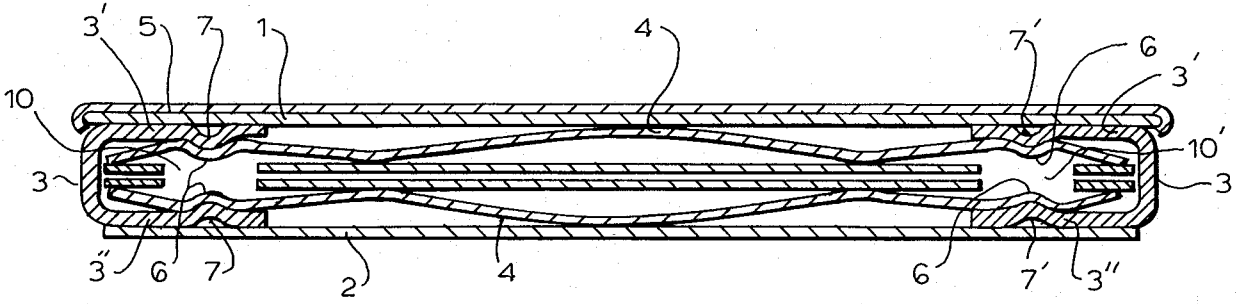
FIG. 2 is a sectional view of the band of link members according to line II—II in FIG. 1.

As can be seen from FIG. 2, the leaf springs 4 are provided with bendings at each end thereof which are developed in a known manner as flexures directed towards the inner side of the link members 1, 2. The clips 3 are each of U-shape and have two shanks 3', 3'' which each are provided with flexures 7, 7' for cooperation with the flexures 6, 6' of the leaf springs 4 so as to fix the clip 3 in a secure manner. Since the connecting part of the shanks of each clip 3 is exposed, a modification of the length can easily be carried out by removing the clips 3 from the link members 1, 2 with a respective tool and after modification of the length to insert them again into the link members 1, 2.

The inner sides of the link members 1, 2 have at their face ends a narrow recess 8, 8' defined by lugs 9, 9'. Through these recesses 8, 8' the narrow end of the leaf springs 4 protrudes in a known manner during the stretching of the band. As can be seen from FIG. 2, the ends of the leaf springs are inclined in a downward manner in order to facilitate the insertion of the clips 3.

Figure 3:
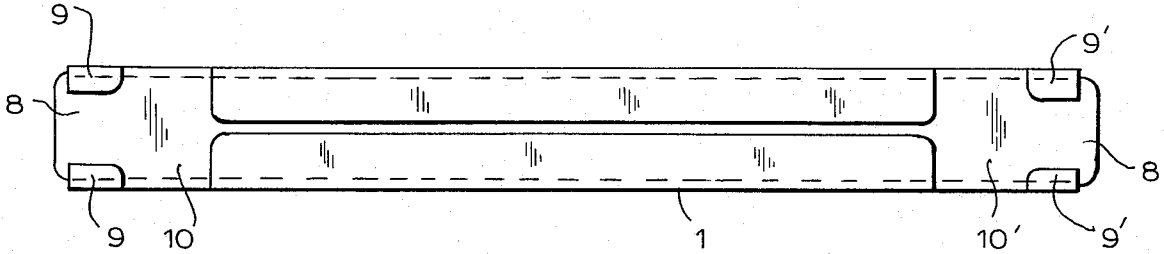
FIG. 3 illustrates an upper link member of the inventive band in a top view seen from below.

In the vicinity of each recess 8, 8', the link members 1, 2 are provided with additional cut-outs 10, 10' which, as shown in FIG. 3, extend over the entire width of the inner sides of the link members. When the band or strap is stretched, the cut-outs 10, 10' are then exposed and the flexures 6, 6' of the leaf springs 4 protrude into these cut-outs 10, 10'. Consequently, the spring path is not prematurely limited as in presently known link members having closed inner sides. The height of the link members 1, 2 is thus essentially smaller in comparison to known band structures.

It will be understood that each of the elements described above, or two or more together, may also find a useful application in other types of flexible bands of link members differing from the types described above.

While the invention has been illustrated and described as embodied in a flexible band of link members, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A flexible band, in particular a wristwatch strap, comprising: an upper and lower layer of link members; a plurality of U-shaped clips, each of which connecting an upper and a lower link member and having two shanks respectively provided with an inwardly directed flexure; and a plurality of leaf springs each of which extending within an associated link member and having a further inwardly directly flexure at opposing end portions thereof for cooperating with an associated flexure of the clip and the end portions of each of the leaf springs are downwardly inclined so as to facilitate insertion of the respective clips and connection of the upper and lower link, wherein each of the link members has an inner side provided with a recess at each end thereof, wherein each of the link members is provided with an additional cut-out at each end and in the vicinity of each recess with each cut-out being separated from each other so that upon stretching of the band the ends of the respective leaf spring protrude into the recess and the further flexure of each leaf spring protrudes into the cut-out.

2. A band as defined in claim 1, wherein each link member has a width, the additional cut-outs extending over the entire width of each link member.

* * * * *